US007127764B1

(12) United States Patent
Harding et al.

(10) Patent No.: US 7,127,764 B1
(45) Date of Patent: Oct. 31, 2006

(54) MATERNITY AIR MATTRESS WITH ADJUSTABLE BELLOWS SYSTEM

(76) Inventors: Diane Harding, 10455 Oakdale Ave., Chatsworth, CA (US) 91311; Ronald Gillyard, 4949 Vanalden, Tarzana, CA (US) 91356

( * ) Notice: Subject to any disclaimer, the term of this patent is extended or adjusted under 35 U.S.C. 154(b) by 0 days.

(21) Appl. No.: 11/414,187

(22) Filed: May 1, 2006

(51) Int. Cl.
*A47C 27/10* (2006.01)

(52) U.S. Cl. ..... 5/735; 5/713; 5/930

(58) Field of Classification Search ..... 5/735, 5/731, 631, 632, 930, 706, 710, 713, 644, 5/654, 655.3
See application file for complete search history.

(56) References Cited

U.S. PATENT DOCUMENTS 3,988,793 A * 11/1976 Abitbol ..... 601/11
4,054,960 A * 10/1977 Pettit et al. ..... 5/631
4,694,515 A * 9/1987 Rogers, Jr. ..... 5/13
4,737,999 A * 4/1988 Halverson ..... 5/710
4,819,287 A * 4/1989 Halverson ..... 5/710
5,185,897 A * 2/1993 Van Laanen ..... 5/710
D335,999 S * 6/1993 Van Driessche ..... D6/604
5,237,712 A * 8/1993 Ramsay ..... 5/710
5,412,824 A * 5/1995 Emerson et al. ..... 5/632
5,425,147 A * 6/1995 Supplee et al. ..... 5/713
5,679,040 A * 10/1997 Bianchi-Holm ..... 441/129
D392,145 S * 3/1998 Thurston ..... D6/604
5,819,348 A * 10/1998 Ryan ..... 5/735
D403,194 S * 12/1998 Thurston ..... D6/604
5,890,246 A * 4/1999 Davis ..... 5/735
6,233,768 B1 * 5/2001 Harding ..... 5/735
6,568,015 B1 * 5/2003 Allen ..... 5/735
6,761,604 B1 * 7/2004 Hronek ..... 441/129
6,959,464 B1 * 11/2005 Fahey ..... 5/735

* cited by examiner

*Primary Examiner*—Robert G. Santos
(74) *Attorney, Agent, or Firm*—James F. Cottone

(57) ABSTRACT

An improved multiple chambered maternity mattress (10) is specially configured to include a bellows (24) for providing fine-grained adjustability of size and firmness of its centrally disposed womb well region (AWW). The bellows (24) consisting of a plurality of accordion-like sections which are interconnected to form a single expandable air chamber that is inflatable under the control of the user while actually in use via a remote control unit (16). The womb well is formed as a cylindrical cavity or opening (26) which extends for the full height of the mattress (10) such that the bellows (24) may change its effective height thereby establishing the physical size of the womb well for optimum user comfort and benefit. Low friction materials and/or coatings on the cylindrical cavity walls (28) assure minimal friction of the contacting surfaces and bellows tips assuring an infinitely fine height/size/firmness adjustment.

10 Claims, 2 Drawing Sheets

MATERNITY AIR MATTRESS WITH ADJUSTABLE BELLOWS SYSTEM

TECHNICAL FIELD

The present invention relates generally to an improved air mattress adapted for supporting pregnant women, and more particularly to a specially configured mattress that includes a unique bellows system to provide smooth and fine adjustability of a womb well for optimally supporting the abdomen of a woman throughout a pregnancy.

BACKGROUND

Specially designed and configured inflatable air mattresses for providing a comfortable and healthy resting or sleeping environment for pregnant women have a long history of development. As is well known, as a pregnancy progresses a woman's ability to find a comfortable resting position on conventional mattresses decreases significantly. In past years, this has led to the development of many types of mattresses having a suitably located central cavity to accommodate the distended abdomen. However, the degree and orientation of abdomen expansion changes dramatically over time, and a mattress with a more or less static cavity size, or other fixed attributes, cannot provide the needed comfort and other health benefits for the full range of fetus development.

In recent years, air mattresses of various types have been proposed, some of which have moved the pregnancy mattress art in useful directions. The basic ability of a variably inflatable air mattress does allow for a certain amount of dynamic accommodation over time.

Descriptions of typical prior art approaches to air mattresses for pregnant women may be found in a number of U.S. patents, and particular attention is now being addressed to the feature of adjustability of their abdomen receiving cavities.

U.S. Pat. No. 5,237,712 to Ramsay teaches the use of three separately inflatable rings in a maternity mattress to provide adjustable support for a pregnant woman's abdomen. This is done by adjusting the degree of inflation of one or more of the ring-shaped chambers which are permanently fixed in position and are concentrically disposed.

U.S. Pat. No. 5,185,897 to Van Laanen shows a centrally disposed cylindrical cavity extending through a maternity mattress wherein pressurized air is supplied to a chamber formed between top and bottom flexible panels to provide adjustable depth of the cavity.

Beyond the purely maternity mattress teachings, a number of other U.S. patents are also of interest. U.S. Pat. No. 3,606,623 to Aymar discloses the use of air filled bellows sections to adjustably position patients' bodies on beds.

Other U.S. patents of interest in the present context are: U.S. Pat. No. 6,568,015 to Allen; U.S. Pat. No. 5,425,147 to Supplee et al.; and U.S. Pat. No. 5,244,452 to Vaccaro et al.

While each of these prior art teachings appears to be addressing selected aspects of providing an ideal resting or sleeping medium for pregnant women—or indeed for persons in general or obese or infirm persons—they have not addressed the full range of attributes needed to optimize a pregnant user's selection of womb well size and firmness. It is exactly this long felt need that the present invention admirably meets via its uniquely configured bellows system allowing for the first time a smooth, finely adjustable and user selectable establishment of optimal womb well size and firmness.

OBJECTS OF THE INVENTION

It is therefore a primary object of the present invention to provide an improved air mattress for pregnant women which will overcome the disadvantages of the prior art approaches and devices.

A further object of the present invention is to provide an improved maternity mattress which includes a bellows-like system to produce smooth and fine-grained adjustability for a centrally disposed abdomen receiving mattress region.

A still further object of the present invention is to provide a multiple chambered maternity mattress including a separate high pressure air chamber for the user's head, a main air chamber for optimally distributing body support, internal support structures and a separately inflatable central bellows system, all of which function in combination to provide fine womb well adjustability, increased mattress shape integrity and dynamic stability.

A yet further object of the present invention is to provide a centrally disposed womb well in its main mattress air chamber fitted with a bellows system to smoothly and finely accommodate a user's expanded abdomen and provide infinitely fine adjustability over the course of a pregnancy.

In a preferred embodiment, a multiple chambered air mattress is formed to include a centrally disposed womb well into which is fitted a unique bellows system that is separately inflatable so as to provide fine adjustability in size and firmness for a user's abdomen. The bellows system includes a bellows element consisting of a plurality of accordion-like sections which are interconnected to form a single expandable air chamber that is inflatable under the control of the user while actually in use via a remote control unit. The womb well is formed as a cylindrical cavity which extends for the full height of the mattress such that the bellows may change its effective height thereby establishing the physical size of the womb well for optimum user comfort. Low friction materials and/or coatings on the cylindrical cavity walls assure minimal friction of the contacting surfaces and bellows tips assuring an infinitely fine height/size/firmness adjustment.

BRIEF DESCRIPTION OF THE DRAWINGS

Additional objects and advantages of the invention will become apparent to those skilled in the art as the description proceeds with reference to the accompanying drawings wherein.

BEST MODE FOR CARRYING OUT THE INVENTION

Figure 1:
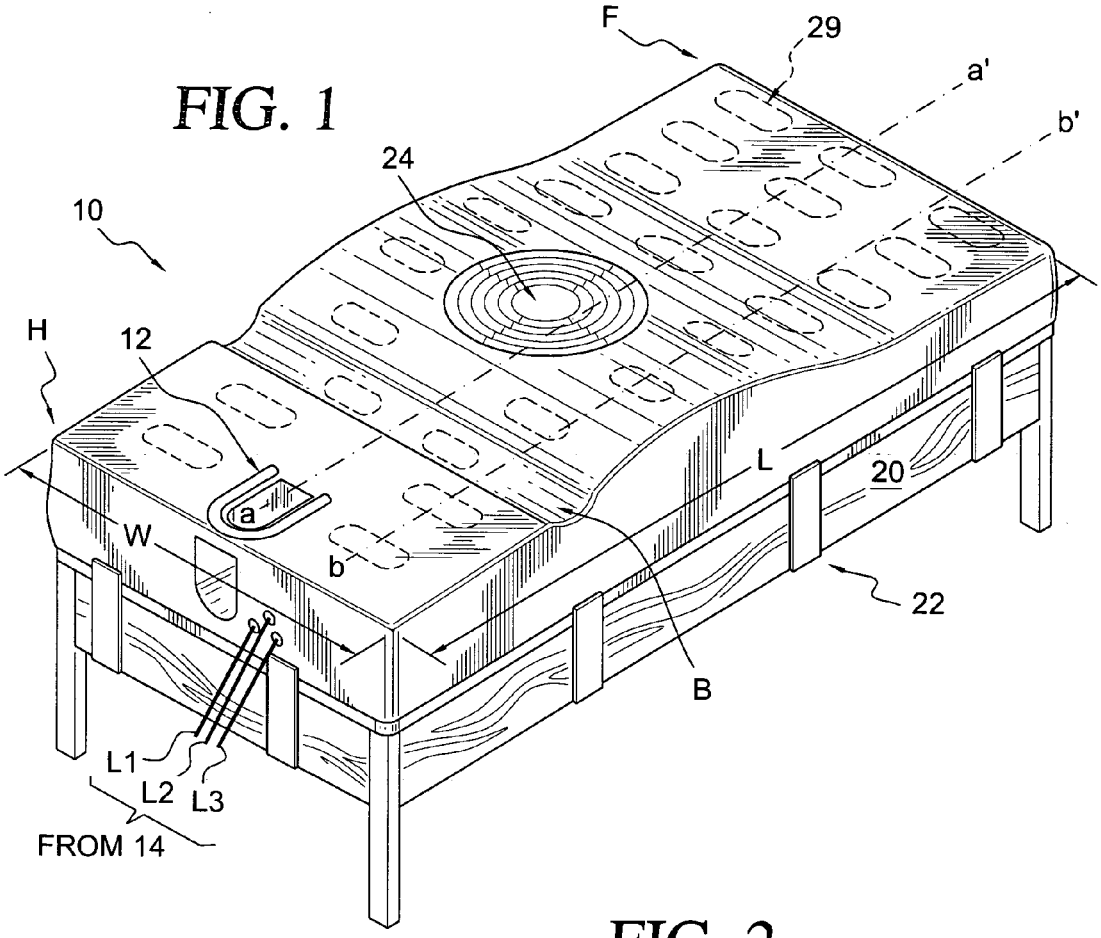
FIG. 1 is a perspective view of an improved maternity air mattress according to the present invention.
Figure 3:
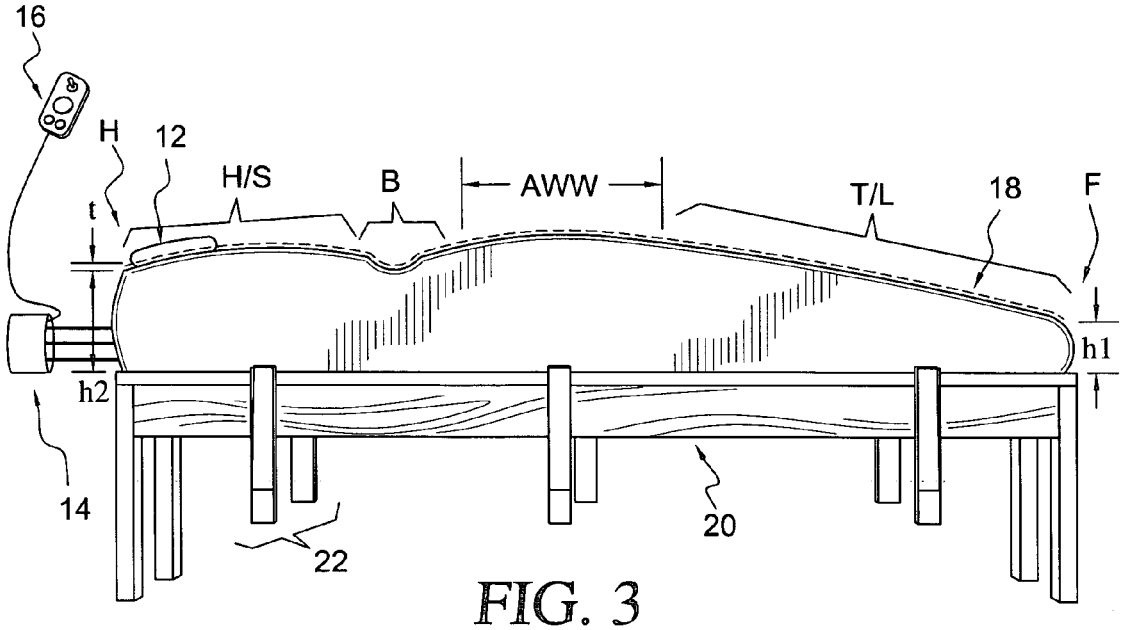
FIG. 3 is a right side elevational view of the maternity mattress of FIG. 1.

Referring now to FIG. 1, there is shown a perspective view of an improved maternity air mattress according to the present invention. To facilitate a brief initial overview of the invention, refer also to the right side view of FIG. 3 of the maternity mattress A mattress 10 is shown as being generally rectangular in horizontal cross-section, and having a length L taken along a central longitudinal axis a–a', and a width W, taken along an orthogonal transverse axis (not shown). To provide the desired comfort and other benefits to a user, the height of mattress 10 varies smoothly along its length from a low of nominally six inches shown as dimension h1 at a foot end F, to nominally 8 inches shown as dimension h2 at a head end H. Between these two ends are four distinctly contoured regions defined by smoothly varying heights which contribute to providing the benefits as described fully below. A first head and shoulders region H/S rises gently in height from the head end H toward its mid-section, and thereafter gently slopes down to a breast indentation region B. The breast region extends longitudinally for nominally six inches. A third adjustable womb well region AWW again rises gently in height from the low of region B to a height of approximately 12 inches near its mid-section, and thereafter smoothly tapers down through a thigh and leg region T/L to the low height h1 at foot end F.

The mattress 10 includes a face rest pillow 12 securely affixed to an upper head end of its region H/S, shown as being generally rounded in cross section and of horseshoe overall shape, and further includes an automatic air inflation means 14. The automatic inflation means 14 may be user-controlled via a remote control unit 16 so as to selectively inflate the several distinct air chambers within mattress 10 via three (illustratively) air lines designated L1, L2 and L3. The mattress 10 may further include a memory foam overlay covered with a breathable cotton cover, both elements indicated by the dotted lines 18 (not shown in FIG. 1 for simplicity of exposition). The relative thickness of these two layers is indicated by the dimension "t" shown proximate the height designation h2. In use, the mattress 10 may be disposed over a massage table or a bed frame-like structure 20, and may include a plurality of Velcro security straps 22 to anchor itself to cooperating hook/loop elements affixed to the table/bed frame.

Figure 4:
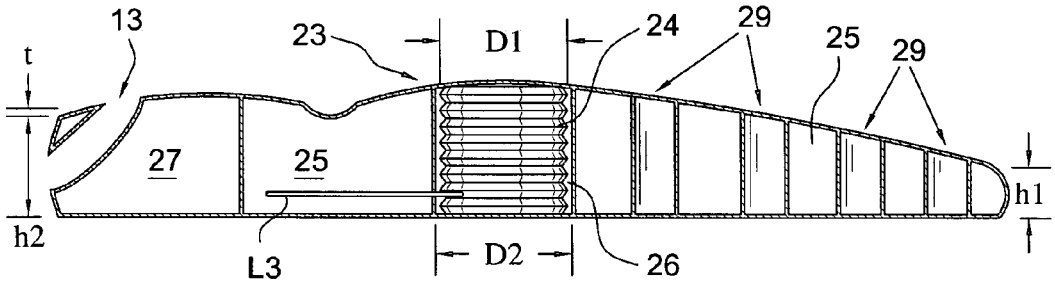
FIG. 4 is a longitudinal cross-sectional view taken along the line a–a' of FIG. 1.
Figure 5:
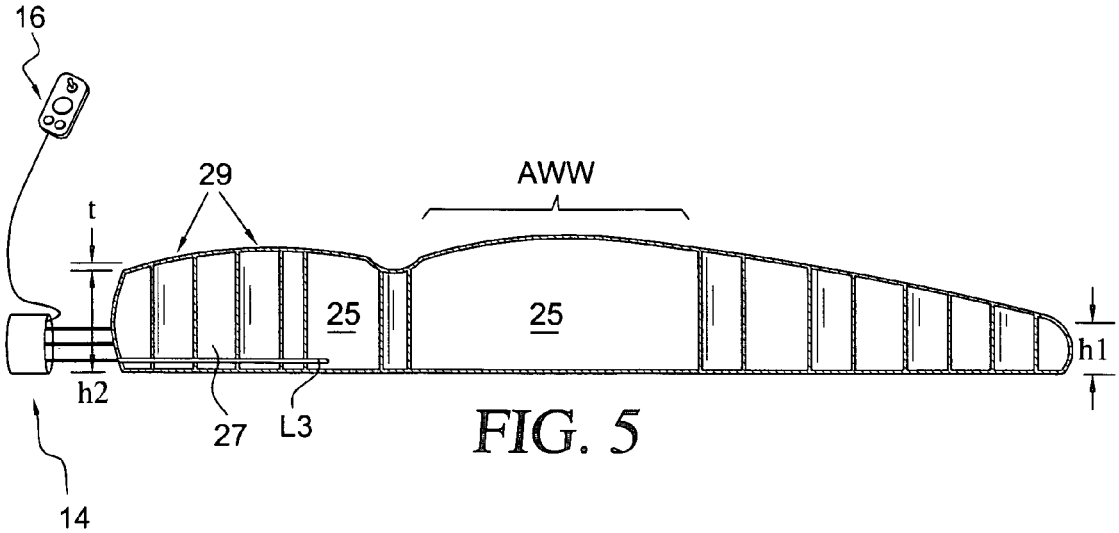
FIG. 5 is a longitudinal cross-sectional view taken along the line b–b' of FIG. 1.

In a preferred embodiment, the maternity mattress 10 may be made largely of heavy gauged poly vinyl chloride (PVC). Preferably, the mattress is made in several sizes, these may include: a massage table size of approximately 72 inches long by 29 inches wide; a regular twin size of approximately 72 inches long by 36 inches wide; and a full size of approximately 72 inches long by 51 inches wide. As with the applicant's previously patented invention entitled "Multiple Air Chamber Contoured Maternity Mattress" bearing U.S. Pat. No. 6,233,768 (hereby incorporated by reference in full herein), three separately inflatable chambers are provided, including a main mattress air chamber 25 inflatable via the line L2, a high pressure chamber 27 inflatable via the line L1, as well as the face rest pillow 12 and its breathing facilitating passageway 13. The top surface outlines (in dashed lines) of a plurality of comfort baffles 29 depict their race track-like horizontal cross sections, and twenty four of them (illustratively) are shown in FIG. 1 as distributed in a predetermined pattern throughout the extent of the mattress 10. (Cross sectional views of a number of these baffles are also shown in FIGS. 4 and 5). Full details on these various elements, regions and chambers described thus far, as well as others yet to be described, along with their interactive functions and benefits are available to the interested reader by reference to the aforementioned U.S. Pat. No. 6,233,768.

As is well known, air mattresses generally, as well as water mattresses and similar fluid filled, flexible devices, exhibit highly undesirable supporting instabilities when carrying dynamic loads, such as an articulated moving person. These instabilities are particularly detrimental when supporting pregnant women (as well as obese persons) because it is very difficult if not impossible for the user to achieve a comfortable position and maintain it thereafter. The slightest amount of user motion triggers off mattress shape/user weight flexing interactions that tend to induce unwanted other relative motions that negate the comfort previously achieved. It is exactly these instabilities that the present mattress minimizes so that the comfort and other benefits provided via the array of shapes, contours, separate chambers and other structures built in to the mattress 10 are not transitory.

Figure 2:
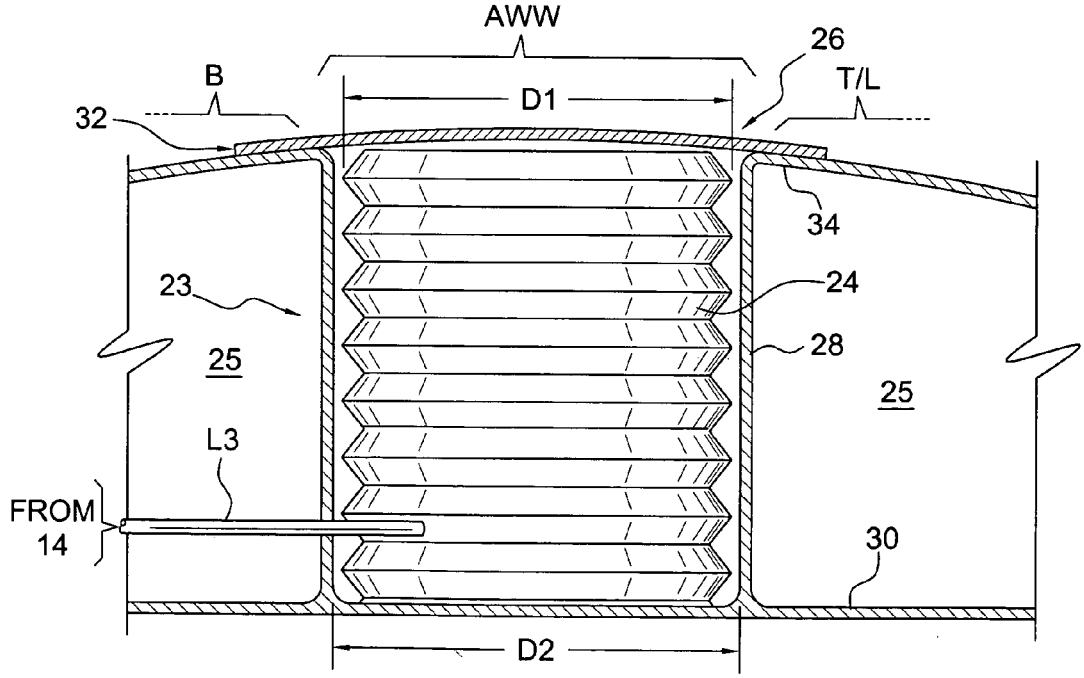
FIG. 2 is a cross-sectional view of an inflatable bellows element which provides the adjustability of the womb well as employed in the maternity air mattress according to the present invention.

A significant and critical feature of the mattress 10 is its unique bellows system which provides for infinitely smooth adjustability of the size and firmness of the womb well. Referring now to FIG. 2 there is shown a cross-sectional view of a bellows system 23 which produces the greatly improved benefit afforded by the present invention. The system 23 including a bellows element 24 is shown as consisting of a plurality of accordion-like sections to form a unitary inflatable structure. With reference now also to FIG. 4, it is seen that the bellows 24 is housed within a cylindrically shaped opening 26 which extends for the full height of mattress 10. The opening 26 has an interior diameter D2 slightly greater than a diameter D1 of the bellows element 24, and low friction walls 28 to allow for smooth movement of the bellows 24 within the opening 26. The air supply line L3 is routed from the inflation means 14 through the intervening chambers to the interior of bellows 24 for inflation, deflation or maintenance of a desired pressure, all three of which functions may be described generally as bellows air (or other suitable gas) pressurization. The bottom surface of bellows 24 is affixed (for example by adhesives or heat tacking) to a lower wall 30 of the air chamber 25, and the interior surfaces of walls 28 may be permanently coated with a low friction material to insure smooth, stiction free movement of the bellows tips. Alternatively, the walls 28 themselves may be formed of low friction plastic material, and the tips of the bellows sections may also be similarly structured or coated. A thin top layer 32 of highly flexible plastic material is affixed (again illustratively by adhesives or tacking) to an upper wall 34 of the air chamber 25.

With continued reference to FIG. 2, the height of the bellows 24 approximates that of the mattress 10 itself in the AWW region (approximately 12 inches). Note that in FIG. 2, baffles 29 are not shown, merely for simplicity. While not specifically illustrated, it is clear that under conditions of reduced air pressure (i.e., by venting) via the line L3, the height of the bellows 24 would be lessened causing a recession or concavity in the flexible upper top layer 32. This comes about naturally due to the weight of the bellows structure itself, or due to a combination of the bellows structure and pressures exerted by the weight of a suitably positioned abdomen. Also while not specifically shown, the flexibility of the top layer 32 allows for a slightly higher extension of the bellows 24 under conditions of increased air pressure and minimal external weight loading producing a slight upwards bulging or convexity (to approximately 15 inches). The key to the usefulness and effectiveness of this particular unique means for adjusting the womb well lies in the ability of a user to precisely set the degrees of firmness and height in infinitely small steps by use of the remote control 16. The term 'infinitely small steps', referred to also as being of 'fine-grained' adjustments or movements, flows naturally from the ability of bellows 24 to move in a low friction environment under control of small pressure changes. So the most minute step size or granularity of womb well size may be readily set by the degree of air pressure controlled by the inflation means 14. While the size/height/firmness parameters all, of course, interact, the desired parameter can be made fully responsive to a user's input via the remote control unit 16.

The bellows system described thus far in terms of cylindrical shapes for the bellows 24 and opening 26 may readily be implemented using other shapes. Alternate shapes such as ovals and race track-like—in horizontal cross section—would function identically and are contemplated for use in the mattress 10. Also, the bellows system is shown as extending vertically for the full vertical extent of mattress 10 (i.e., between upper wall 34 and lower wall 30). Clearly, a shortened actual height bellows may be employed in alternate embodiments of the present invention.

In the longitudinal cross sectional view taken along the line b–b' of FIG. 1, note the passage of inflation line L3 through the high pressure chamber 27, and into the main mattress chamber 25 before being routed into the bellows 24 as seen in FIG. 5.

In use, the bellows systems described provide a highly effective and advantageous arrangement which gives the long sought after capability of easy and fine adjustability of womb wells for pregnant women. This is a significant advantage over present prior art approaches which employ one or more discretely inflatable 'pillows' or 'disks' to approximate the desired, optimal abdomen support. Additionally, gone are the complex mental steps needed to combine pillows of different thicknesses, inflatable or otherwise, as well as the problems associated with locating misplaced or long stored away removable pillows or disks.

Although the invention has been described in terms of selected and preferred embodiments, the invention should not be deemed limited thereto, since other embodiments and modifications will readily incur to one skilled in the art. For example, the specific bellows element described may be replaced by a fully equivalent but alternately configured expansible element, and the remote control unit may be readily implemented by wireless means. It is therefore to be understood that the appended claims are intended to cover all such modifications as fall within the true spirit and scope of the invention.

The invention claimed is:

1. A multiple chambered maternity mattress having a bellows for providing fine-grained size and firmness adjustability of a centrally disposed womb well section, comprising:

(a) a mattress having two or more separately inflatable sections including at least one main section for supporting a person's body and a variably-sized womb well section for supporting a person's abdomen;

(b) said womb well section having a centrally disposed cylindrical chamber and a cylindrical bellows positioned within said chamber; and (c) whereby upon adjusting the pressure within said bellows the effective size and firmness of said womb well section may be established.

2. The maternity mattress of claim 1 wherein said cylindrical bellows is formed as a plurality of accordion sections to provide a single, vertically expandable element, whereby the size and firmness of said womb well section is established responsive to the vertical dimension of said bellows.

3. The maternity mattress of claim 1 wherein the walls of said chamber are formed of or are coated with low friction material such that fine-grained vertical movement of said bellows is achieved.

4. The maternity mattress of claim 1 further comprising user controlled inflation means, said means permitting establishment and maintenance of a desired degree of pressurization within said at least one main section and said womb well section.

5. The maternity mattress of claim 1 wherein said cylindrical chamber is a generally oval chamber in horizontal cross section and said cylindrical bellows is a generally oval bellows in horizontal cross section.

6. A method of providing fine-grained adjustments of a womb well section of a multiple chambered maternity mattress comprising the steps of:

(a) providing a mattress having two or more separately inflatable sections including at least one main section for supporting a person's body and a variably-sized womb well section for supporting a person's abdomen;

(b) providing a womb well section having a centrally disposed cylindrical chamber and a cylindrical bellows positioned within said chamber; and (c) providing user controlled inflation means, said inflation means permitting establishment and maintenance of separate desired degrees of pressurization within said at least one main section and said womb well section.

7. The method of claim 6 wherein said bellows is formed as a plurality of accordion sections to provide a single vertically expandable element whereby the size and firmness of said womb well section is established responsive to the vertically expanded dimension of said bellows.

8. The method of claim 6 including the further step of providing friction minimizing means between said chamber and said bellows said means selected from the group including low friction material forming the walls of said chamber and low friction coating applied to the walls of said chamber and low friction material forming at least the tips of said bellows and low friction coatings applied to at least the tips of said bellows.

9. The method of claim 6 including the further step of providing a centrally disposed chamber selected from the group including a chamber having a horizontal cross section of circular shape and a chamber having a horizontal cross section of oval shape and a bellows having a horizontal cross section of circular shape and a bellows having a horizontal cross section of oval shape.

10. A multiple chambered maternity mattress having a bellows for providing fine-grained size and firmness adjustability of a womb well formed within a centrally disposed womb well section, comprising:

(a) a mattress having two or more separately inflatable sections including at least one main section for supporting a person's body and a variably-sized womb well within a womb well section for supporting a person's abdomen, said sections inflatable with a gaseous medium such as air:

(b) said womb well section having a centrally disposed cylindrical chamber and a cylindrical bellows positioned within said chamber; and (c) whereby upon adjusting the pressure within said bellows the effective size and firmness of said womb well may be established.

* * * * *